US007743596B1

(12) United States Patent
Chou et al.

(10) Patent No.: US 7,743,596 B1
(45) **Date of Patent: *Jun. 29, 2010**

(54) HIGH TEMPERATURE RESISTANT ROPE SYSTEMS AND METHODS

(75) Inventors: Chia-Te Chou, Bellingham, WA (US); Phillip Anthony Roberts, Blaine, WA (US); Michael C. Greenwood, Mission Viejo, CA (US); Danielle Dawn Stenvers, Ferndale, WA (US); Wolfgang Manfred Wilke, Surrey (CA); Eric McCorkle, Bellingham, WA (US)

(73) Assignee: Samson Rope Technologies, Ferndale, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/255,191

(22) Filed: Oct. 21, 2008

Related U.S. Application Data

(63) Continuation of application No. 11/700,354, filed on Jan. 30, 2007, now Pat. No. 7,437,869, which is a continuation of application No. 10/655,649, filed on Sep. 5, 2003, now Pat. No. 7,168,231.

(60) Provisional application No. 60/408,250, filed on Sep. 5, 2002.

(51) Int. Cl.
*D02G 3/20* (2006.01)

(52) U.S. Cl. ..... 57/229; 57/210

(58) Field of Classification Search ..... 57/210, 57/224, 229, 237; 87/6, 9, 13
See application file for complete search history.

(56) References Cited

U.S. PATENT DOCUMENTS 3,367,095 A 2/1968 Field, Jr.
3,415,052 A 12/1968 Stanton
3,481,134 A 12/1969 Whewell
3,729,920 A 5/1973 Sayers et al.
3,762,865 A 10/1973 Weil
3,839,207 A 10/1974 Weil
3,906,136 A 9/1975 Weil
3,957,923 A 5/1976 Burke
3,979,545 A 9/1976 Braus et al.
4,031,121 A 6/1977 Brown
4,257,221 A 3/1981 Feinberg
4,312,260 A 1/1982 Morieras
4,500,593 A 2/1985 Weber
4,762,583 A 8/1988 Kaempen (Continued)

*Primary Examiner*—Shaun R Hurley
(74) *Attorney, Agent, or Firm*—Michael R. Schacht; Schacht Law Office, Inc.

(57) ABSTRACT

A fire resistant rope and method of making the same. The fire resistant rope comprises a core, a jacket, and a fire retardant coating. The core comprises a plurality of strands. Each core strand comprises a plurality of core yarns, and each core yarn comprises a plurality of high tensile strength fibers. The jacket comprises a plurality of jacket strands. Each jacket strand comprises a plurality of jacket yarns and each jacket yarn comprises a plurality of high temperature resistant fibers. The fire retardant coating formed on at least one of the core and the jacket. The fire retardant coating expands when subjected to temperatures above a state-change level. At least a portion of the expanded coating inhibits transfer of heat to the core. The state-change level is below a failure temperature defined by the materials from which at least some of the fibers forming the core are formed.

20 Claims, 8 Drawing Sheets

U.S. PATENT DOCUMENTS

| | | | | |
|---|---|---|---|---|
| 4,784,918 | A | 11/1988 | Klett et al. | |
| 4,868,041 | A | 9/1989 | Yamagishi et al. | |
| 4,958,485 | A | 9/1990 | Montgomery et al. | |
| 5,091,243 | A | 2/1992 | Tolbert et al. | |
| 5,141,542 | A | 8/1992 | Fangeat et al. | |
| 5,501,879 | A | 3/1996 | Murrayama | |
| 5,506,043 | A | 4/1996 | Lilani | |
| 5,931,076 | A | 8/1999 | Ryan | |
| 6,045,571 | A | 4/2000 | Hill et al. | |
| 6,146,759 | A | 11/2000 | Land | |
| 6,164,053 | A | 12/2000 | O'Donnell et al. | |
| 6,295,799 | B1 | 10/2001 | Baranda | |
| 6,365,070 | B1 | 4/2002 | Stowell et al. | |
| 6,410,140 | B1 | 6/2002 | Land et al. | |
| 6,592,987 | B1 | 7/2003 | Sakamoto et al. | |
| 7,127,878 | B1 | 10/2006 | Wilke et al. | |
| 7,134,267 | B1 | 11/2006 | Gilmore et al. | |
| 7,168,231 | B1 * | 1/2007 | Chou et al. | 57/210 |
| 7,367,176 | B1 | 5/2008 | Gilmore et al. | |
| 7,389,973 | B1 | 6/2008 | Chou et al. | |
| 7,437,869 | B1 * | 10/2008 | Chou et al. | 57/229 |

* cited by examiner

HIGH TEMPERATURE RESISTANT ROPE SYSTEMS AND METHODS

RELATED APPLICATIONS

This application is a continuation of U.S. patent application Ser. No. 11/700,354 filed on Jan. 30, 2007, issued on Oct. 21, 2008 as U.S. Pat. No. 7,437,869, which is a continuation of U.S. patent application Ser. No. 10/655,649 filed on Sep. 5, 2003, now U.S. Pat. No. 7,168,231, which claims benefit of U.S. Provisional Patent Application Ser. No. 60/408,250, which was filed on Sep. 5, 2002, the contents of all related applications listed above are incorporated herein by reference.

TECHNICAL FIELD

The present invention relates to rope systems and methods and, in particular, to rope systems that can withstand high temperatures and methods of making such rope systems.

BACKGROUND OF THE INVENTION

The characteristics of a given type of rope determine whether that type of rope is suitable for a specific intended use. Rope characteristics include breaking strength, elongation, flexibility, weight, abrasion resistance, and coefficient of friction. The intended use of a rope will determine the acceptable range for each characteristic of the rope. The term "failure" as applied to rope will be used herein to refer to a rope being subjected to conditions beyond the acceptable range associated with at least one rope characteristic.

The present invention relates to the ability of a rope to withstand high temperature, or temperature resistance. Temperature resistance may be quantified as a maximum temperature level at which a rope will operate for a predetermined time without failure. Intended uses for which temperature resistance is an important characteristic include firefighting and lines for boats or ships. The present invention is of particular relevance when applied to lines for use with ships, and that intended use of the present invention will be described herein in detail.

The term "fire wire" is used to refer to rescue lines for ships that are used to pull a ship during a fire. The term "Emergency Tow Off Pendant (ETOP)" is also used to refer to fire wire type products. Conventionally, fire wire is formed by a metal cable. Metal cables have a high breaking strength and low elongation, even when subjected to high temperatures. However, metal cables are difficult to work with because they are relatively heavy and inflexible.

The need thus exists for improved ropes which exhibit high breaking strength and low elongation even when subjected to high temperatures, and which are relatively light and flexible; the need also exists for systems and methods for producing such improved ropes.

SUMMARY OF THE INVENTION

The present invention is a fire resistant rope and method of making the same. The fire resistant rope comprises a core, a jacket, and a fire retardant coating. The core comprises a plurality of strands. Each core strand comprises a plurality of core yarns, and each core yarn comprises a plurality of high tensile strength fibers. The jacket comprises a plurality of jacket strands. Each jacket strand comprises a plurality of jacket yarns and each jacket yarn comprises a plurality of high temperature resistant fibers. The fire retardant coating formed on at least one of the core and the jacket. The fire retardant coating expands when subjected to temperatures above a state-change level. At least a portion of the expanded coating inhibits transfer of heat to the core. The state-change level is below a failure temperature defined by the materials from which at least some of the fibers forming the core are formed.

The present invention may also be embodied as a method of forming a fire resistant rope comprising the following steps. A plurality of high tensile strength fibers are combined into a plurality of high tensile strength yarns. The plurality of high tensile strength yarns are combined into a plurality of high tensile strength strands, and the plurality of high tensile strength strands are combined to form a core. A plurality of high temperature resistant fibers are combined into a plurality of high temperature resistant yarns. The plurality of high temperature resistant yarns are combined into a plurality of high temperature resistant strands, and the high temperature resistant strands are combined to form a jacket around the core, where an intermediate zone is defined by the core and the jacket. A fire retardant coating material that expands when subjected to temperatures above a state-change level is provided. The state-change level is below a failure temperature defined by the materials from which at least some of the fibers forming the core are formed. The coating material is applied to the core such that at least a portion of the fire retardant coating inhibits transfer of heat to the core above the state-change level.

The present invention may also be embodied as a fire resistant rope comprising high tensile strength fibers, high temperature resistant fibers, and afire retardant coating. The high tensile strength fibers are combined to form a core. The high temperature resistant fibers are combined to form a jacket that at least partly covers the core. The jacket is configured to inhibit movement of air to the core. The fire retardant coating operates in a first state below a state-change temperature level and a second state at or above the state-change temperature level. The state-change temperature level is below a failure temperature level defined by the fire resistant rope. A volume of the fire retardant coating is minimized in the first state. The volume of the fire retardant coating increases to insulate the core when fire resistant coating is in the second state.

DETAILED DESCRIPTION OF THE INVENTION

Figure 1:
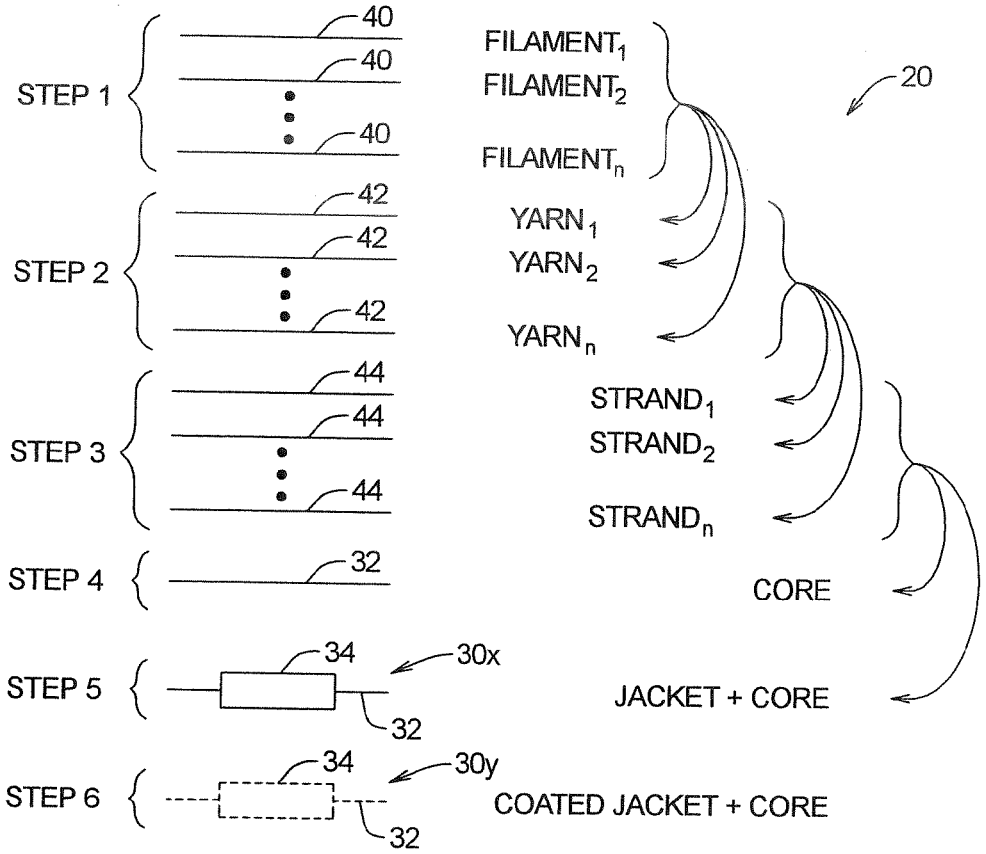
FIG. 1 is a highly schematic diagram illustrating a first embodiment of a process of making a fire resistant rope according to the principles of the present invention.

Referring initially to FIG. 1 of the drawing, depicted therein is a first example process 20 for making fire resistant rope in accordance with, and embodying, the principles of the present invention. Produced by the example rope-making process 20 is a fire resistant rope 30 of the present invention. The example rope making process 20 comprises six steps. Step 6 is an optional coating step that may be performed to enhance the fire resistant properties of the rope 30.

Figure 2:
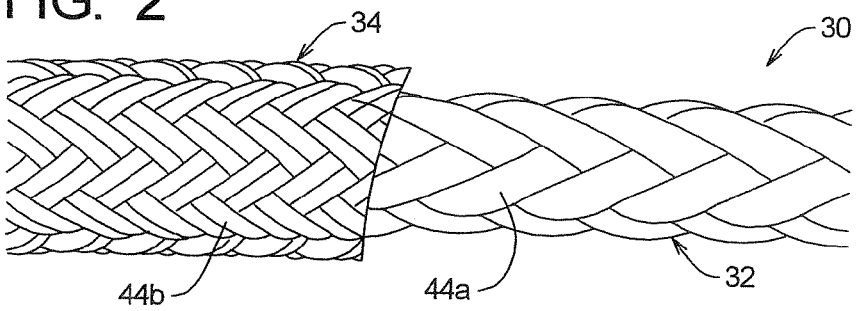
FIG. 2 is a side elevation view of one embodiment of a fire resistant rope of the present invention.

As perhaps best shown in FIG. 2, the example fire resistant rope 30 comprises a core 32 and a jacket 34. The exemplary core 32 and jacket 34 are formed of synthetic materials using a braiding process. The example rope 30 is thus the type of rope referred to in the industry as a double-braided synthetic rope. Alternatively, the components of the rope 30 can be made using a twisting process instead of a braiding process. As will be described in further detail below, the rope 30 has improved ability to withstand high temperatures as compared to conventional double-braided synthetic ropes.

As depicted in FIG. 1, Step 1 of the rope making process 20 is the manufacture of a plurality of fibers or filaments. Step 2 of the process 20 is to combine the filaments 40 to form a plurality of yarns 42. The filaments 40 may be combined to form the yarns 42 using a variety of processes. One possible method of combining filaments 40 to form the yarns 42 is to lightly twist a plurality of the filaments 40 together. The filaments 40 are manufactured and combined to form the yarns 42 by a fiber manufacturer and not a rope manufacturer. Systems and methods of combining filaments to form a yarn are well-known in the art and will not be described herein in detail.

FIG. 1 further illustrates that Step 3 of the process 20 is to combine a plurality of yarns 42 to form a plurality of strands 44. The yarns 42 are combined to form the strands 44 by the rope manufacturer. The yarns 42 are typically twisted together to form the strands 44, but other methods of combining yarns into strands may also be used. Systems and methods of combining yarns to form a strand are well-known in the art and will not be described herein in detail.

The characteristics of the yarns and process used to combine the yarns to form strands will be determined based on the intended use of the rope. As perhaps best shown in FIGS. 3, 4B, and 4A, the example rope 30 comprises two types of strands 44*b* and 44*a*. The core 32 and jacket 34 can, however, be made of the same type of strand or yarn, and other strand or yarn types and processes of combining strands or yarns can be used to manufacture a rope falling within the scope of the present invention.

A variety of materials and combinations of materials can be used to manufacture a rope product according to the principles of the present invention. Initially, the filaments 40 can be made of a variety of materials. The yarns 42 are comprised of filaments of a single material or a blend of filaments made of different materials. The strands 44 can also be comprised of yarns of a single type or a blend comprised of yarns of different types of materials.

When filaments or yarns of different materials are used, the materials can be selected such that the rope 30 has a desirable mix of characteristics arising from the combination of material characteristics. For example, certain materials exhibit high tensile strength and yield a rope with a high breaking strength. Other materials may exhibit low tensile strength but have insulation properties that enhance the ability of the rope 30 to withstand high temperatures.

The following list of acceptable filament or yarn materials identifies examples of acceptable materials from which the filaments 40 or yarns 42 may be formed: PBO, M5, PBI, Aramid, Carbon, Glass, Ceramic, Basalt, Melamine, Polyimide, Polyetheretherketone (PEEK), polyesters, nylon, and PTFE. With the exception of polyester, PTFE, and nylon, all of the materials in the list of acceptable filament or yarn materials exhibit both high tensile strength and high temperature resistance and can be used alone or in combination to form one or both of the core 32 and the jacket 34. Polyesters and nylon exhibit primarily high tensile strength and are only suitable for use in the core 32 of the temperature resistant rope 30. PTFE exhibits primarily high temperature resistance and is best suited for use in the jacket 34 of the temperature resistant rope 30.

Referring again to FIG. 1, Step 4 of the process 20 combines the strands 44 to form the core 32 of the rope 30. As with the formation of the yarns and strands as described above, the number of strands, sizes and composition of strands, and method of combining the strands to form the core will typically be chosen based on factors such as cost, manufacturing capabilities, and the intended use of the rope. Systems and methods of combining strands to form a core or rope are well-known in the art and will not be described herein in detail.

Figure 3:
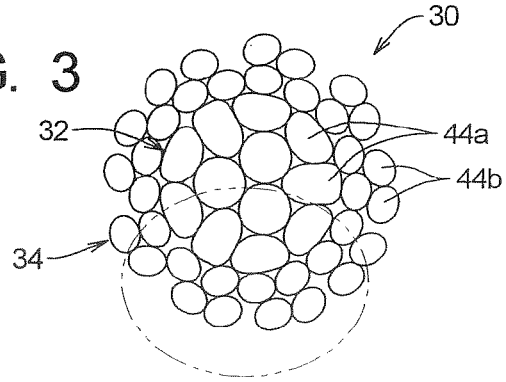
FIG. 3 is an end cut-away view taken along lines 3-3 in FIG. 2.

As perhaps best shown in FIG. 3, the example core 32 comprises twelve strands 44*a* of a first type. The strands 44*a* of the example core 32 are braided together, and FIG. 2 depicts the strands 44*a* in a visual pattern associated with braided strands.

In the following discussion, the suffix "x" will be used below in conjunction with the reference character "30" to identify that the rope 30 is uncoated after Step 4 of the process 20. The suffix "y" is used in conjunction with the reference character "30" to indicate that a fire retardant coating has been applied to the rope 30 during the optional Step 6 of the process 20 as will be described in further detail below. In addition, in the schematic diagrams of FIGS. 1 and 5-10, broken lines are used to indicate rope components that are coated with fire retardant material or are made of components that are coated with such a material.

After the core 32 is formed. FIG. 1 illustrates that Step 5 of the process 20 is to form the jacket 34 from a plurality of strands. As with the formation of the yarns, strands, and core as described above, the number of strands, sizes and composition of strands, and method of combining the strands to form the jacket will typically be chosen based on factors such as the intended use of the rope. Systems and methods of combining strands to form a jacket are well-known in the art and will not be described herein in detail.

As well-known in the art, the jacket 34 is formed around the core 32. More specifically, the core 32 is generally in the shape of an elongate solid cylinder and, as perhaps best shown by FIG. 3, has a generally circular cross-section. The braiding process used to form the jacket 34 results in the jacket 34 generally being in the shape of a hollow cylinder and having a generally annular cross-section. The outer diameter of the core 32 is approximately the same as the inner diameter of the jacket 34. The core 32 thus lies substantially entirely within the jacket 34 during normal use of the rope 30.

FIG. 3 further shows that the example jacket 34 comprises thirty-two strands 44*b* of a second type. The strands 44*b* of the example jacket 34 are braided together, and FIG. 2 illustrates a visual pattern associated with a jacket formed by braided strands.

For some intended uses, optional Step 6 may be omitted, and the uncoated rope 30*x* may be used without further processing.

For improved fire resistance, Step 6 may be performed. In particular, during Step 6 of the process 20 the uncoated rope 30*x* is coated with a coating material to obtain the coated rope 30*y*. During Step 6, the coating material is applied to the rope 30*x* in a liquid form and allowed to set or dry.

In the example rope 30, the uncoated rope 30*x* is dipped or soaked in a container of the coating material in liquid form and then removed to allow the coating material to dry to form afire retardant coating 60. Other coating methods, such as spraying the liquid coating material onto the uncoated rope, may be used instead or in conjunction with the soaking process.

Figure 4B:
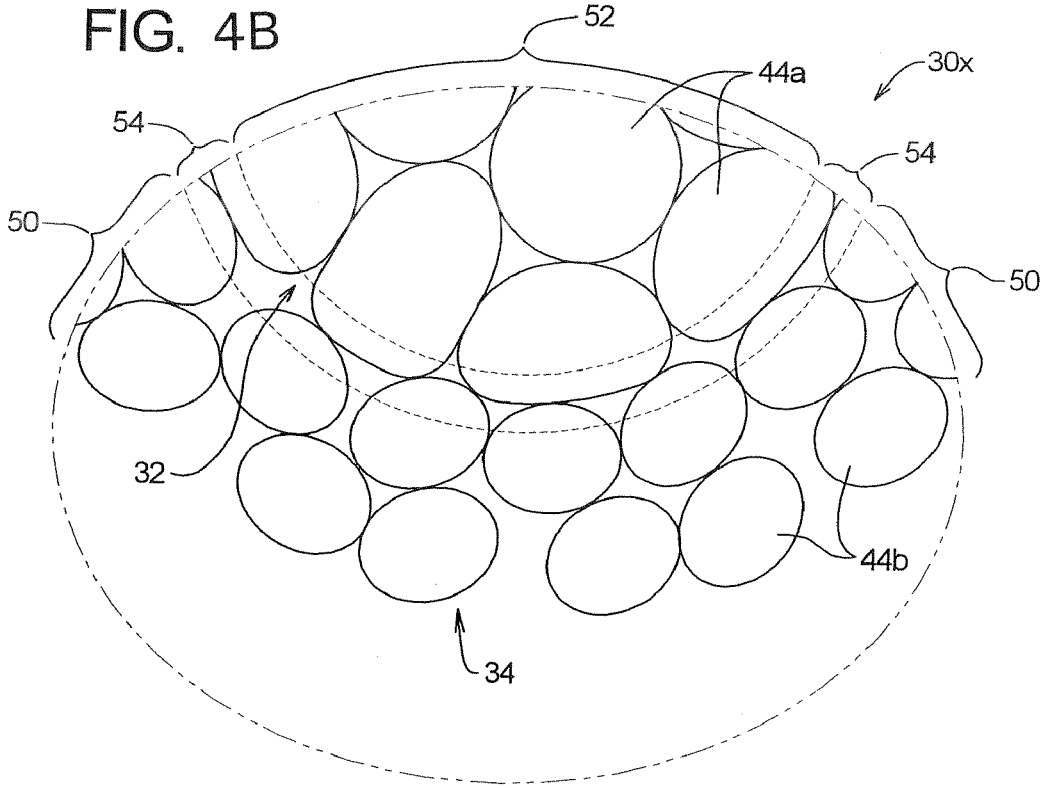
FIG. 4B is a close-up view depicting a portion of the fire resistant rope before a coating step of the process depicted in FIG. 1.

FIG. 4B is a close-up, cross-sectional view of the uncoated rope 34 after Step 5 of the process 20. Although the strands 44*b* of the jacket 34 lie in close proximity to each other. FIG. 4B illustrates that three connected zones of interstitial gaps are formed by the uncoated rope 34. An outer zone of gaps 50 is formed by the strands 44*b* of the uncoated jacket 34. An inner zone of gaps 52 is formed by strands 44*a* of the uncoated core 32. An intermediate zone of gaps 54 is formed between the strands 44*b* of the uncoated core 32 and the strands 44*b* of the uncoated jacket 34.

Figure 4A:
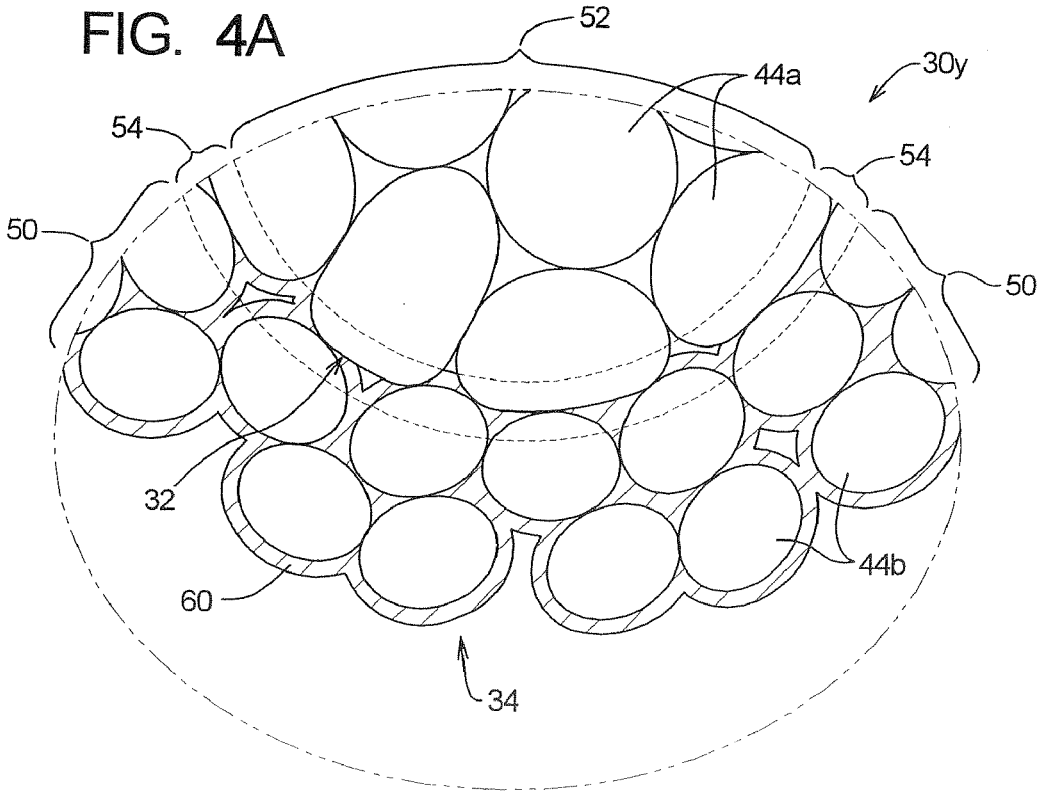
FIG. 4A is a close-up view depicting a portion of the fire resistant rope after the coating step of the process depicted in FIG. 1.

FIG. 4A is a close-up, cross-sectional view of the coated rope 34 after Step 6 of the process 20. As shown in FIG. 4A, the outer zone of gaps 50 is at least partly filled with a fire retardant coating 60. The degree to which the coating 60 fills the zones 50, 52, and/or 54 of interstitial gaps is determined by factors such as the viscosity of the coating material in liquid form and the manner in which the liquid coating material is applied. In the example rope 30 as depicted in FIG. 4B, liquid coating material has penetrated into the jacket 34 to substantially fill the outer zone of gaps 50 and at least partially fill the intermediate zone of gaps 54. The inner zone of gaps 52 is substantially devoid of the coating 60. Alternatively, leaving the rope 30 in the container of liquid coating material for a longer period of time (increasing soak time) allows the liquid coating material to penetrate further into the core 32. In this case, the coating may fill some or the entire inner zone of gaps 52.

As another alternative, creating a pressure differential between the liquid coating material and the rope 30*x* would increase the flow rate of the liquid coating material into the rope 30*x*. Pressurizing the liquid coating material could thus reduce the soak time required to obtain the structure depicted in FIG. 4B or to obtain deeper penetration of the coating for the same soak time.

If the liquid coating material is applied by spraying rather than soaking, a layer of coating may adhere to the exposed surfaces of the strands 44*b* in the jacket 34. Using the spraying process, the coating typically will not substantially enter the outer zone 50 of interstitial gaps.

The exemplary coating 60 is formed of a water-based polymer. When not subjected to high temperatures, the coating 60 does not significantly alter characteristics of the rope 30*y* such as breaking strength, resistance to elongation, and/or coefficient of friction. The coating 60 will add some weight and may slightly reduce the flexibility of the coated rope 30*y* as compared to the uncoated rope 30*x*. The coating 60 may, however, improve the abrasion resistance of the coated rope 30*y* as compared to the uncoated rope 30*x*.

When subjected to high temperatures, the coating 60 expands to inhibit heat transfer. In particular, the coating 60 operates in a first state within a predetermined range and in a second state outside of the predetermined range. In the first state, the volume of the coating 60 is minimized, and the coating 60 thus does not substantially affect or interfere with the operation of the rope 30. In the second state, the coating 60 expands, thereby increasing the volume of the coating 60. The insulation properties of the coating 60 improve with the increased volume, which results in increased thickness of the coating 60. Accordingly, the coating 60 alters its state as necessary to maximize the insulation properties thereof when necessary to protect the components of the rope 30.

The exact parameters of the predetermined range are not critical to the invention in the broadest sense but will be important for developing a rope for a particular intended use. To ensure that the coating 60 will provide maximum insulation, the predetermined range should take the form of a state-change level at which the coating 60 changes from the first state to a second state. The state-change level should be below the temperature level at which the rope 30 or components thereof will fail. The temperature level at which the rope 30 will fail is determined by the properties of the materials from which the filaments are formed.

In the exemplary rope 30, the state-change level is approximately 450° F. Accordingly, above 450°, the coating 60 on the rope 30*y* will expand to inhibit heat transfer from the exterior of the jacket 34 to the strands 44*b* forming the jacket 34 and the strands 44*a* forming the core 32. The coating 60 will thus protect the jacket 34 and core 32 from high temperatures and increase the ability of the rope 32*y* to operate without failure when exposed to such high temperatures.

The material used to form the coating 60 can be any material that does not significantly adversely affect the operational characteristics of the coated rope 30*x* but which insulates the strands 44 of the rope 30*x* from external heat sources. One example of a material for forming the coating 60 is an intumescent available from Passive Fire Protection Partners (PFPP). To the best of the Applicant's knowledge, the PFPP coating product comprises Ethylene-vinyl Chloride Polymer, water as a base, fillers such as calcium carbonate and Iron Oxide, 1,2-Propylene Glycol as solvent, Texanol brand ester alcohol as a coalescing aid, and undisclosed auxiliary chemicals.

The PFPP coating product has a solid contents (wt %) of approximately 60-70, a pH of approximately 7.0-8.0, a specific gravity of approximately 1.30-1.40, and a viscosity (cps) of approximately 500-1000. The PFPP coating product is intended to be applied at a temperature of ° C. (° F.) 6-32 (43-90). The PFPP coating product dries to the touch in approximately 10-20 minutes and is fully cured after 1-2 days.

The principles of the present invention can be applied to a number of different ropes and at stages of the rope making process other than as described above with reference to FIG. 1. A number of other examples will now be described with reference to FIGS. 6-10 of the drawing.

Figure 5:
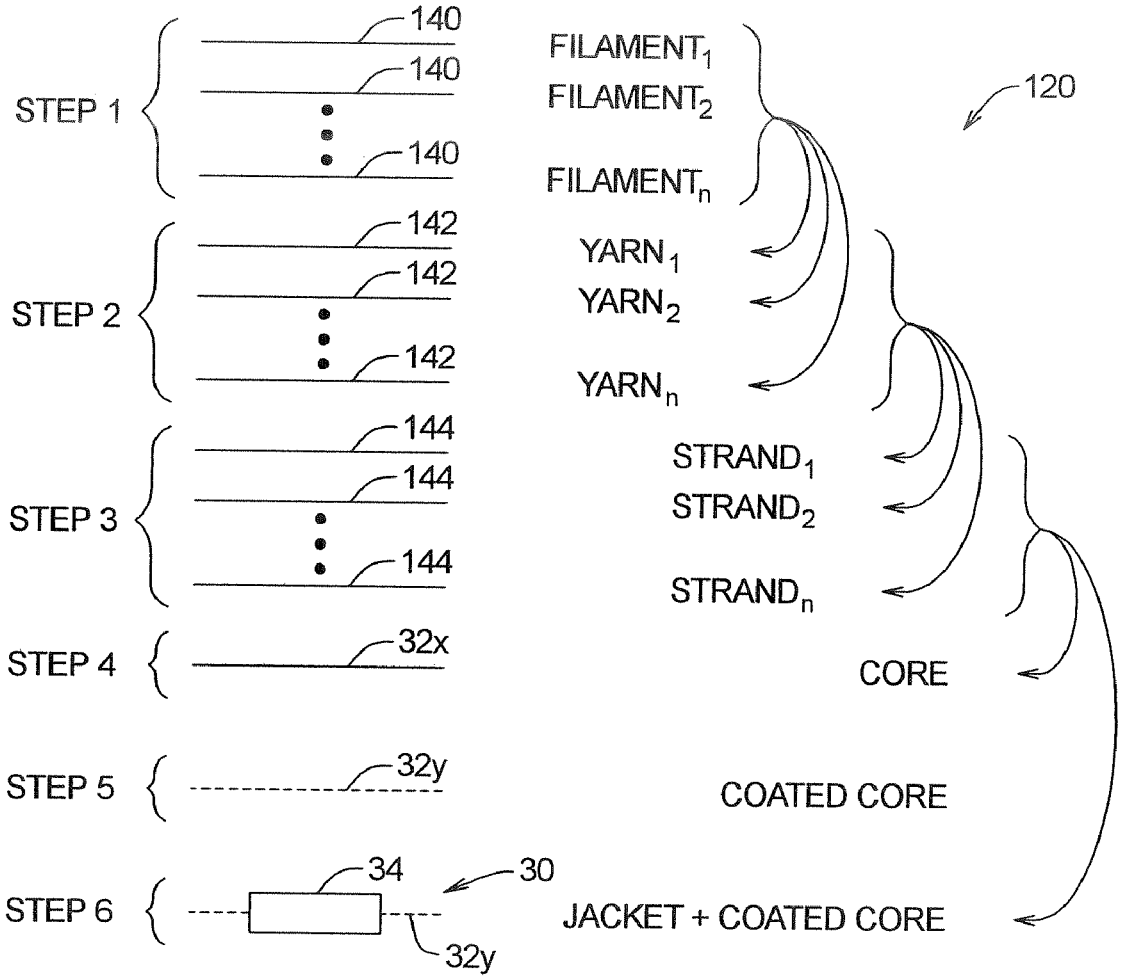
FIG. 5 is a highly schematic diagram illustrating a second embodiment of a process of making a fire resistant rope according to the principles of the present invention.

Referring initially to FIG. 5, depicted therein is a process 120 for making fire resistant rope in accordance with a second embodiment of the present invention. Produced by the example rope-making process 120 is a fire resistant rope 130 of the present invention. The process 120 will only be described herein to the extent it differs from the process 20 described above.

Like the fire resistant rope 30 described above, the fire resistant rope 130 comprises a core 132 and a jacket 134. Filaments 140 are combined into yarns 142 that are in turn combined into strands 144. The strands 144 are in turn combined to form the core 132 and the jacket 134.

Step 5 in the process 120 is a coating step that is performed to enhance the fire resistant properties of the rope 130. More specifically, the core 132 is coated separately. Subsequently, during Step 6, the jacket 134 is formed on the core 132 to obtain the rope 130

Figure 6:
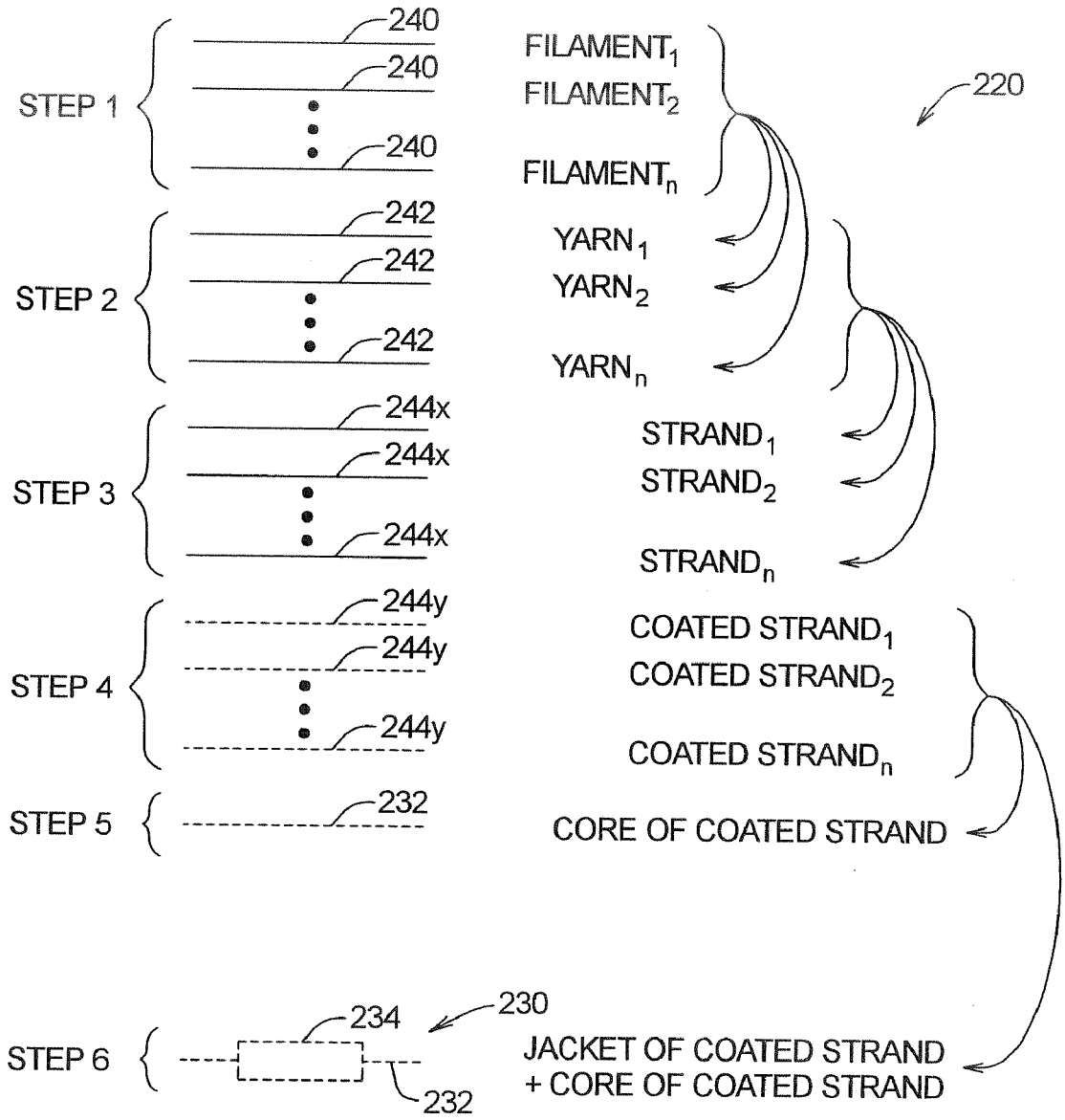
FIG. 6 is a highly schematic diagram illustrating a third embodiment of a process of making a fire resistant rope according to the principles of the present invention.

Referring now to FIG. 6, depicted therein is a process 220 for making fire resistant rope in accordance with a third embodiment of the present invention. Produced by the example rope-making process 220 is a fire resistant rope 230 of the present invention. The process 220 will only be described herein to the extent it differs from the process 20 described above.

Like the fire resistant rope 30 described above, the fire resistant rope 230 comprises a core 232 and a jacket 234. Filaments 240 are combined into yarns 242 that are in turn combined into uncoated strands 244*x*.

Step 4 in the process 220 is a coating step that is performed to enhance the fire resistant properties of the rope 230. At Step 4, the uncoated strands 244*x* are coated to obtain coated strands 244*y*. The coated strands 244*y* are subsequently combined at step 5 to form the core 232 and at Step 6 to form the jacket 234 on the core 232. Both the core 232 and the jacket 234 of the rope 230 are thus formed of coated strands 244*y* to improve the fire resistance properties of the rope 230.

Figure 7:
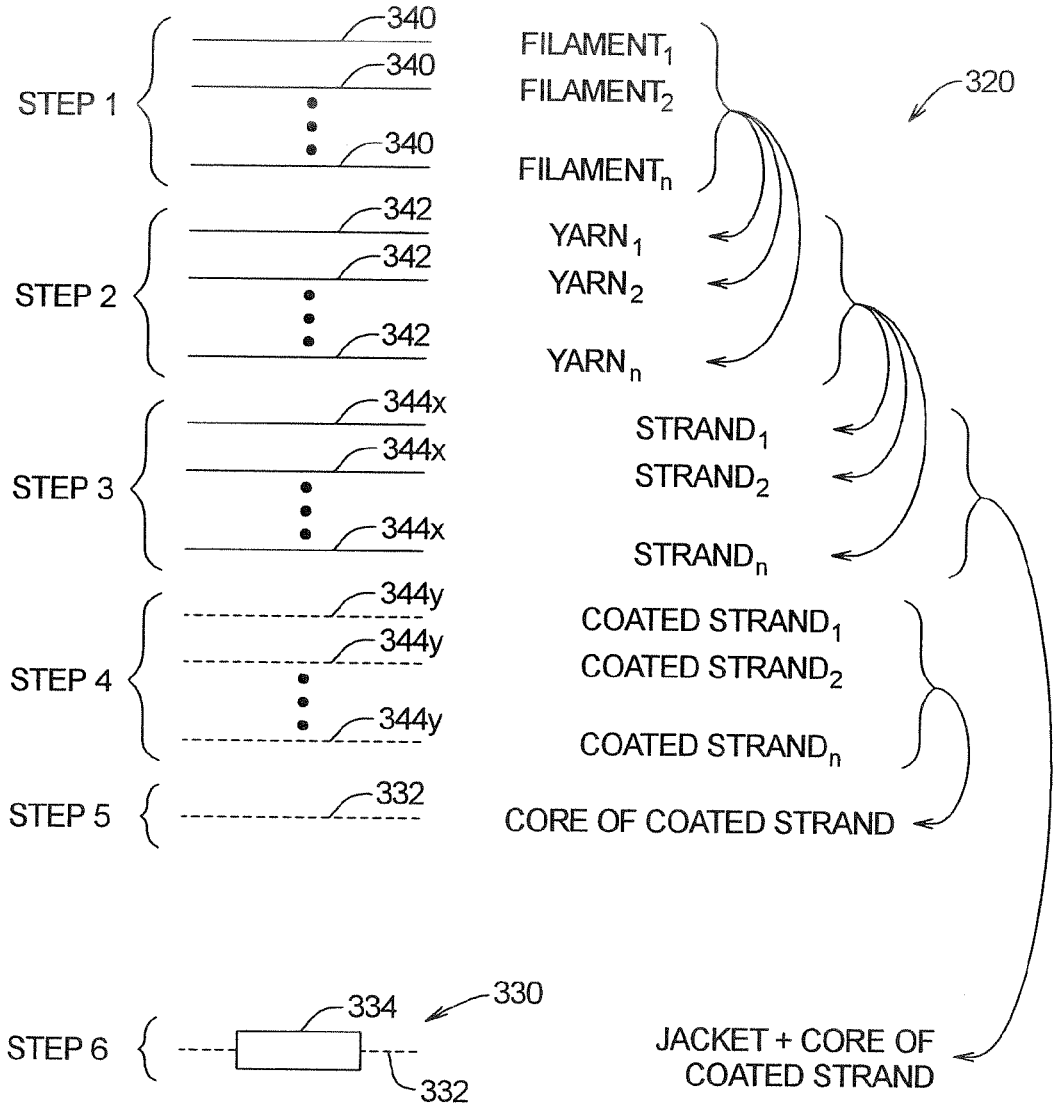
FIG. 7 is a highly schematic diagram illustrating a fourth embodiment of a process of making a fire resistant rope according to the principles of the present invention.

Referring now to FIG. 7, depicted therein is a process 320 for making fire resistant rope in accordance with a fourth embodiment of the present invention. Produced by the example rope-making process 320 is a fire resistant rope 330 of the present invention. The process 320 will only be described herein to the extent it differs from the process 20 described above.

Like the fire resistant rope 30 described above, the fire resistant rope 330 comprises a core 332 and a jacket 334. Filaments 340 are combined into yarns 342 that are in turn combined into uncoated strands 344*x*.

Step 4 in the process 320 is a coating step that is performed to enhance the fire resistant properties of the rope 330. At Step 4, some of the individual uncoated strands 344*x* are coated to obtain coated strands 344*y*. The coated strands 344*y* are combined at step 5 to form the core 332. Uncoated strands 344*x* are combined at Step 6 to form the jacket 334 on the core 332. The core 332 is thus formed of coated strands 344*y* to improve the fire resistance properties of the rope 330.

Figure 8:
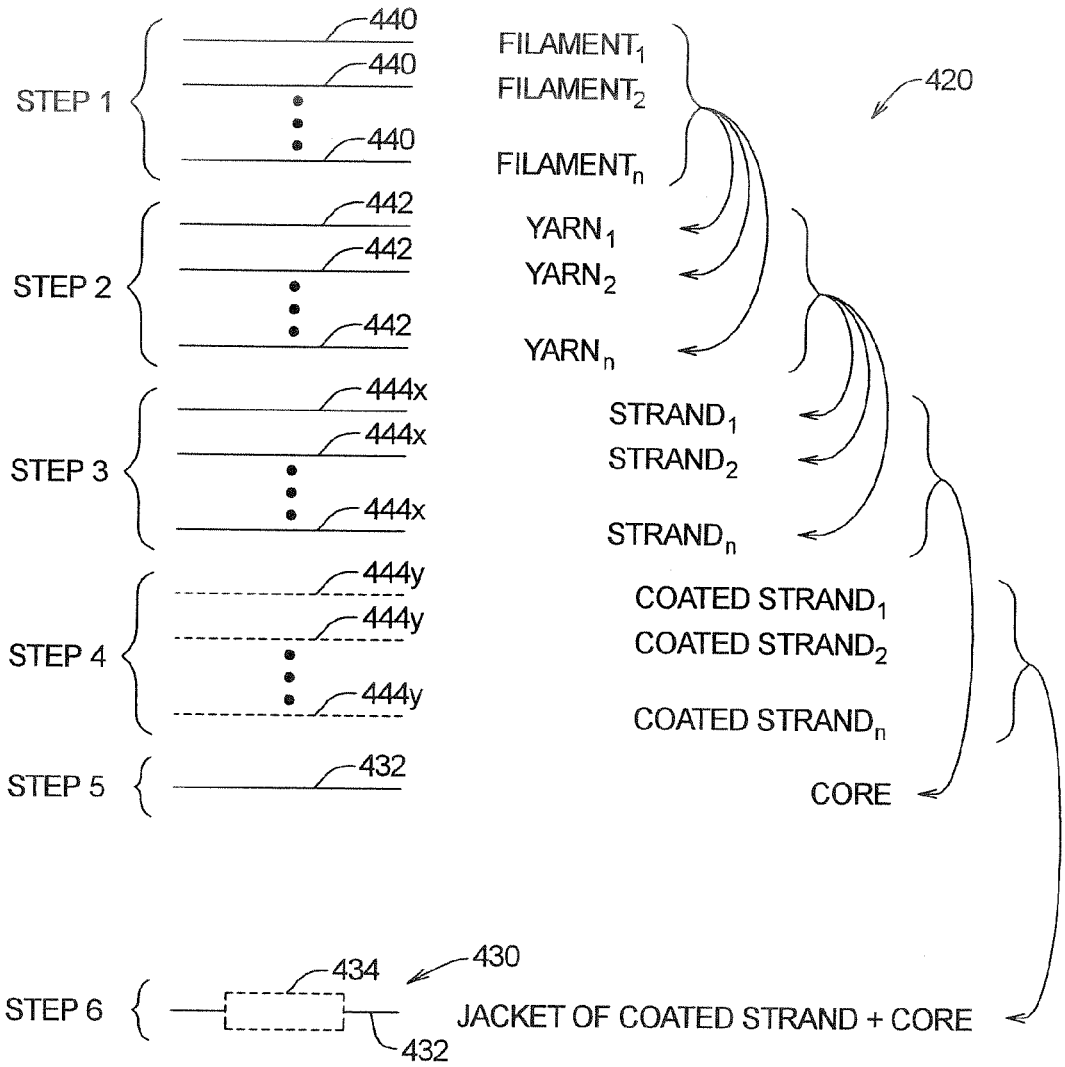
FIG. 8 is a highly schematic diagram illustrating a fifth embodiment of a process of making a fire resistant rope according to the principles of the present invention.

Referring now to FIG. 8, depicted therein is a process 420 for making fire resistant rope in accordance with a fifth embodiment of the present invention. Produced by the example rope-making process 420 is a fire resistant rope 430 of the present invention. The process 420 will only be described herein to the extent it differs from the process 20 described above.

Like the fire resistant rope 30 described above, the fire resistant rope 430 comprises a core 432 and a jacket 434. Filaments 440 are combined into yarns 442 that are in turn combined into uncoated strands 444*x*.

Step 4 in the process 420 is a coating step that is performed to enhance the fire resistant properties of the rope 430. At Step 4, some of the individual uncoated strands 444*x* are coated to obtain coated strands 444*y*. Uncoated strands 444*x* are combined at step 5 to form the core 432. Coated strands 444*x* are combined at Step 6 to form the jacket 434 on the core 432. The jacket 434 is thus formed of coated strands 444*y* to improve the fire resistance properties of the rope 430.

Figure 9:
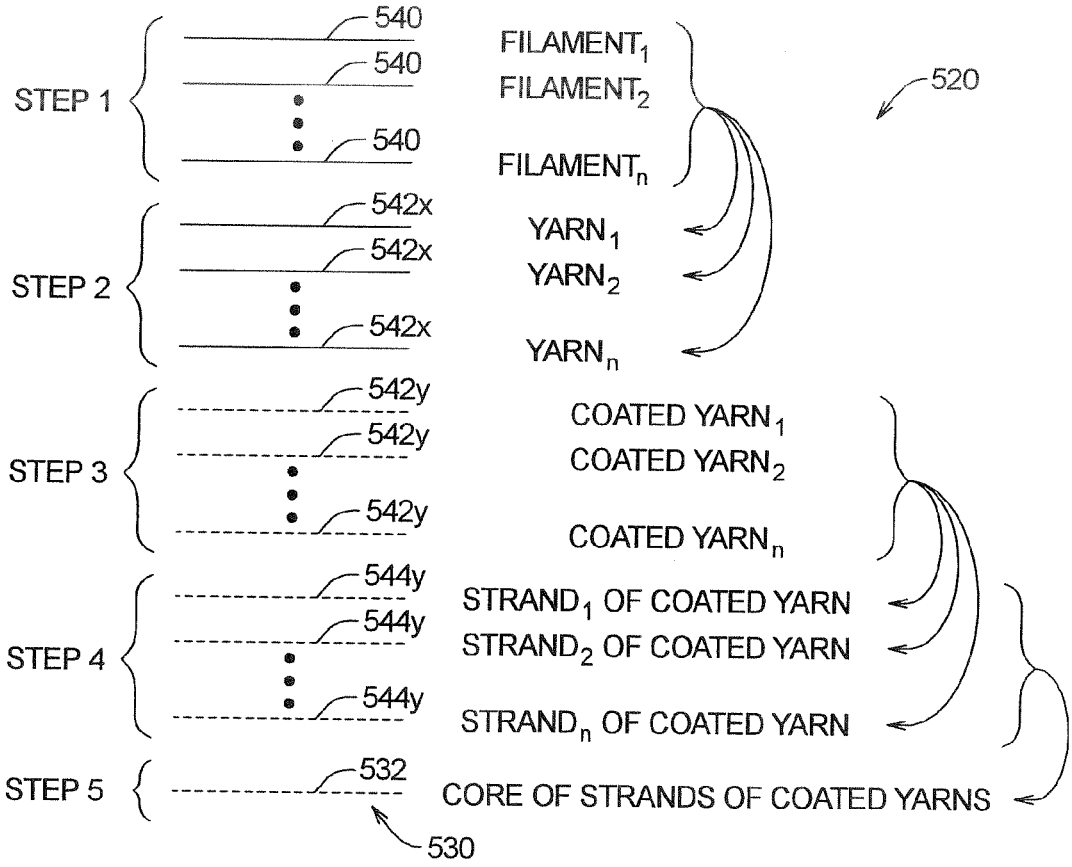
FIG. 9 is a highly schematic diagram illustrating a sixth embodiment of a process of making a fire resistant rope according to the principles of the present invention.

Referring now to FIG. 9, depicted therein is a process 520 for making fire resistant rope in accordance with a fifth embodiment of the present invention. Produced by the example rope-making process 520 is a fire resistant rope 530 of the present invention. The process 520 will only be described herein to the extent it differs from the process 20 described above.

Unlike the fire resistant rope 30 described above, the fire resistant rope 530 comprises only a core 532 and does not comprise a jacket. Filaments 540 are combined into uncoated yarns 542*x*.

Step 3 in the process 520 is a coating step that is performed to enhance the fire resistant properties of the rope 530. At Step 3, the individual uncoated yarns 542*x* are coated to obtain coated yarns 542*y*.

The coated yarns 542*y* are then combined at Step 4 to obtain strands 544. The strands 544 are combined at step 5 to form the core 532 that constitutes the finished rope 530. The finished rope 530 thus has improved resistance to high temperatures.

Optionally, at least some of the strands 544 may be formed at least partly of uncoated yarns 542*x*. In addition, a jacket may be formed on the core 532. The jacket may be uncoated, coated, formed of coated strands, and/or formed of strands formed of coated yarns.

Figure 10:
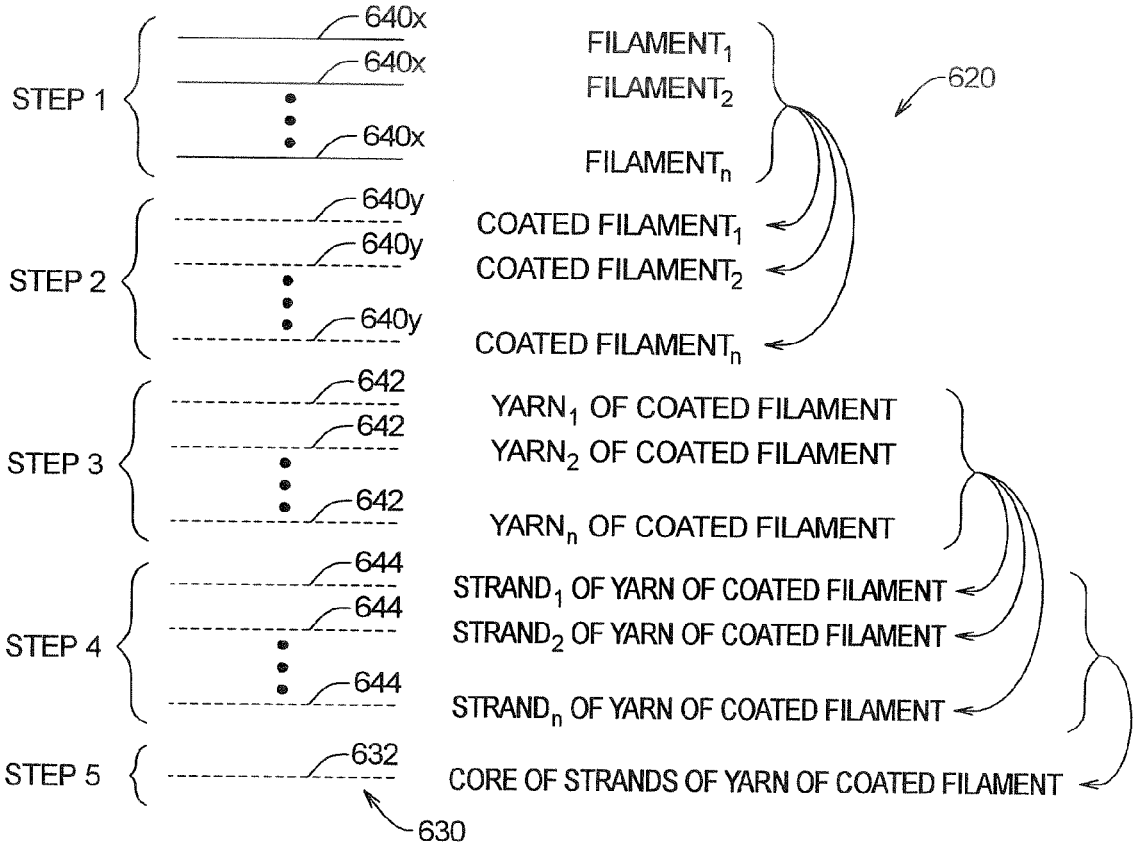
FIG. 10 is a highly schematic diagram illustrating a seventh embodiment of a process of making a fire resistant rope according to the principles of the present invention.

Referring now to FIG. 10, depicted therein is a process 620 for making fire resistant rope in accordance with a fifth embodiment of the present invention. Produced by the example rope-making process 620 is a fire resistant rope 630 of the present invention. The process 620 will only be described herein to the extent it differs from the process 20 is described above. Unlike the fire resistant rope 30 described above, the fire resistant rope 630 comprises only a core 632 and does not comprise a jacket.

During Step 1, uncoated filaments 640*x* are manufactured using conventional techniques. The uncoated filaments 640*x* are then coated at Step 2 to form coated filaments 640*y*.

At Step 3 of the process 620, the coated filaments are combined into yarns 642. The yarns 642 are then combined at Step 4 to obtain strands 644. The strands 644 are combined at step 5 to form the core 632 that constitutes the finished rope 630. Again, the finished rope 530 has improved resistance to high temperatures.

Optionally, some of the yarns 642 may be formed of uncoated filaments 640*x*. In addition, a jacket may be formed on the core 632. The jacket may be uncoated, coated, formed of coated strands, and/or formed of strands formed of coated yarns.

Given the foregoing, it should be clear to one of ordinary skill in the art that the present invention may be embodied in other forms that fall within the scope of the present invention.

What is claimed is:

1. A fire resistant rope comprising:

a core comprising a plurality of strands, where each core strand comprises a plurality of core yarns and each core yarn comprises a plurality of high tensile strength fibers;

a jacket comprising a plurality of jacket strands, where each jacket strand comprises a plurality of jacket yarns and each jacket yarn comprises a plurality of high temperature resistant fibers;

a fire retardant coating formed on at least one of the core and the jacket; wherein the fire retardant coating expands when subjected to temperatures above a state-change level;

at least a portion of the expanded coating inhibits transfer of heat to the core; and the state-change level is below a failure temperature defined by the materials from which at least some of the fibers forming the core are formed.

2. A fire resistant rope as recited in claim 1, in which the high tensile strength fibers forming the core are filaments made of at least one material selected from the group of materials consisting of PBO, M5, PBI, Aramid, Carbon, Glass, Ceramic, Basalt, Melamine, Polyimide, Polyetheretherketone (PEEK), polyesters, and nylon.

3. A fire resistant rope as recited in claim 1, in which the high temperature resistant fibers forming the jacket are filaments made of at least one material selected from the group of materials consisting of PBO, M5, PBI, Aramid, Carbon, Glass, Ceramic, Basalt, Melamine, Polyimide, Polyetheretherketone (PEEK), and PTFE.

4. A fire resistant rope as recited in claim 2, in which the high temperature resistant fibers forming the jacket are filaments made of at least one material selected from the group of materials consisting of PBO, M5, PBI, Aramid, Carbon, Glass, Ceramic, Basalt, Melamine, Polyimide, Polyetheretherketone (PEEK), and PTFE.

5. A fire resistant rope as recited in claim 1, in which the fire retardant coating inhibits movement of air to the core.

6. A fire resistant rope as recited in claim 1, in which the fire retardant coating is applied to at least one of the individual strands, the individual yarns, and the individual filaments.

7. A fire resistant rope as recited in claim 1, in which the fire is retardant coating is a water-based polymer.

8. A method of forming a fire resistant rope comprising the steps of:

providing a plurality of high tensile strength fibers;

combining the high tensile strength fibers into a plurality of high tensile strength yarns;

combining the plurality of high tensile strength yarns into a plurality of high tensile strength strands;

combining the plurality of high tensile strength strands to form a core;

providing a plurality of high temperature resistant fibers;

combining the high temperature resistant fibers into a plurality of high temperature resistant yarns;

combining the plurality of high temperature resistant yarns into a plurality of high temperature resistant strands; and combining the high temperature resistant strands to form a jacket around the core, where an intermediate zone is defined by the core and the jacket;

providing fire retardant coating material that expands when subjected to temperatures above a state-change level, where the state-change level is below a failure temperature defined by the materials from which at least some of the fibers forming the core are formed; and applying the fire retardant coating material to form afire retardant coating around the core such that at least a portion of the fire retardant coating inhibits transfer of heat to the core above the state-change level.

9. A method as recited in claim 8, in which the step of providing the plurality of high tensile strength fibers comprises the step of forming filaments made of at least one material selected from the group of materials consisting of PBO, M5, PBI, Aramid, Carbon, Glass, Ceramic, Basalt, Melamine, Polyimide, Polyetheretherketone (PEEK), polyester, and nylon.

10. A method as recited in claim 9, in which step of providing the plurality of high temperature resistant fibers comprises the step of forming filaments made of at least one material selected from the group of materials consisting of PBO, M5, PBI, Aramid, Carbon, Glass, Ceramic, Basalt, Melamine, Polyimide, Polyetheretherketone (PEEK), and PTFE.

11. A method as recited in claim 9, in which step of providing the plurality of high temperature resistant fibers comprises the step of forming filaments made of at least one material selected from the group of materials consisting of PBO, M5, PBI, Aramid, Carbon, Glass, Ceramic, Basalt, Melamine, Polyimide, Polyetheretherketone (PEEK), and PTFE.

12. A fire resistant rope comprising:

high tensile strength fibers;

high temperature resistant fibers; and a fire retardant coating; wherein the high tensile strength fibers are combined to form a core;

the high temperature resistant fibers are combined to form a jacket that at least partly covers the core;

the jacket is configured to inhibit movement of air to the core; and the fire retardant coating operates in a first state below a state-change temperature level, where a volume of the fire retardant coating is minimized in the first state and the state-change temperature level is below a failure temperature level defined by the fire resistant rope, and a second state at or above the state-change temperature level, where the volume of the fire retardant coating increases to insulate the core when fire resistant coating is in the second state.

13. A fire resistant rope as recited in claim 12, in which the high tensile strength fibers comprise filaments made of at least one material selected from the group of materials consisting of PBO, M5, PBI, Aramid, Carbon, Glass, Ceramic, Basalt, Melamine, Polyimide, Polyetheretherketone (PEEK), polyester, and nylon.

14. A fire resistant rope as recited in claim 12, in which the high temperature resistant fibers comprise filaments made of at least one material selected from the group of materials consisting of PBO, M5, PBI, Aramid, Carbon, Glass, Ceramic, Basalt, Melamine, Polyimide, Polyetheretherketone (PEEK), and PTFE.

15. A fire resistant rope as recited in claim 13, in which the high temperature resistant fibers comprise filaments made of at least one material selected from the group of materials consisting of PBO, M5, PBI, Aramid, Carbon, Glass, Ceramic, Basalt, Melamine, Polyimide, Polyetheretherketone (PEEK), and PTFE.

16. A fire resistant rope as recited in claim 12, in which the fire retardant coating is a water-based polymer.

17. A fire resistant rope as recited in claim 12, in which the failure temperature level is defined by the materials from which the fibers forming the rope are formed.

18. A fire resistant rope as recited in claim 12, in which the fire retardant coating is applied to the high temperature resistant fibers.

19. A fire resistant rope as recited in claim 18, in which the fire retardant coating is also applied to the high temperature resistant fibers.

20. A fire resistant rope as recited in claim 12, in which the coating at least partly fills interstitial spaces defined by at least one of the high tensile strength fibers and the high temperature resistant fibers.

* * * * *